United States Patent [19]

Lee

[11] 3,986,719

[45] Oct. 19, 1976

[54] PORTABLE BALL TARGET

[76] Inventor: John Henry Lee, 602 S. Pearl St., Mart, Tex. 76664

[22] Filed: Feb. 6, 1975

[21] Appl. No.: 547,618

[52] U.S. Cl. ..... 273/181 F; 273/181 J; 273/195 A

[51] Int. Cl.[2] ..... A63B 69/36

[58] Field of Search ..... 273/26 R, 26 A, 181 F, 273/181 E, 181 J, 181 K, 195 A, 176 F, 184 R, 185 R, 185 A, 185 B

[56] References Cited

UNITED STATES PATENTS

| | | | |
|---|---|---|---|
| 920,907 | 5/1909 | Bolton | 273/181 F |
| 928,674 | 7/1909 | Lenz | 273/26 A |
| 1,012,820 | 12/1911 | Cory | 273/176 F |
| 3,001,795 | 9/1961 | Johnson | 273/181 F |
| 3,753,563 | 8/1973 | Previte | 273/195 A |

*Primary Examiner*—George J. Marlo
*Attorney, Agent, or Firm*—James J. Brown

[57] ABSTRACT

The present invention provides a readily portable device for practicing golf in confined indoor or outdoor areas. The device offers a quick set up and tear down feature, unique compactness and substantial improvements over all golf practice devices of prior art in that the present invention not only arrests the flight of a solidly hit golf ball but also catches and retains the ball so that it might be easily retrieved by the practicing golfer. The device, in essence, comprises three main components: a quick assembly, rigid vertical rectangular frame mounted on bilaterally attached uni-directional rockers, a unique net design and a weighted and footed teeing mat. The rigid, vertical, rectangular frame provides vertical support and lateral retention for a unique mesh net which is suspended within the rectangular frame by retention clips which are attached primarily to the uppermost frame member to provide vertical support and which attach loosely near the upper terminus of the frame's bilateral uprights to provide lateral tension and retention.

4 Claims, 6 Drawing Figures

PORTABLE BALL TARGET

BACKGROUND OF THE INVENTION

Since the popularization of golf, the working men and women who became fond of it and who because of their jobs are restricted to playing only on weekends and holidays and who in the large part have learned the proper swing from books and magazine articles, have a need for a means which will allow them to practice driving golf balls when and where the time becomes available. The game of golf, which on the one hand readily lends itself to restricted area practice in its putting phase, almost totally defies solution in its driving phase which requires that the practicing player hit the ball as hard and true as possible. Once hit, the careening ball becomes lethal in confined spaces and must be quickly and efficiently restrained. The prior art has produced many devices which attempt to safely and efficiently solve the problem of practicing driving golf balls in confined areas. The inventor of the present invention tried the various available devices of prior art such as nets, plastic balls, tethered balls, swing devices, etc., and found that they were unsatisfactory in all cases in that they lacked required features such as natural ball contact, portability, safety, rapid ball retrieval, confined area usage, easy set up and disassembly and that specifically and in general even the most effective possessed poor functionality.

The present invention provides a golf or other ball driving practice device that solves the aforementioned problems of the present art and effectively provides a practice device for ball driving or hitting practice that can be used in any confined area that provides enough room to swing freely plus a few extra feet in which to set up the device. The device is light, easily erected, readily portable, offers natural ball contact and rapid ball retrieval. It is extremely safe in that it not only positively stops the flight of a driven ball but also catches a properly driven ball and holds it until the person retrieves it.

SUMMARY OF THE INVENTION

The present invention relates to a new and unique portable practice set for golf or other ball driving or hitting practice such as baseball that not only arrests the flight of a driven or hit ball but also restrains caught balls until purposely retrieved by the practicing golfer, thereby providing an efficient and safe device for confined area driving practice.

An important object of this invention is to provide a practice device that will catch and hold a driven ball until said ball is purposely removed.

Yet another object of this invention is to provide a practice device that is readily portable.

A still further object of this invention is to provide a golf practice device that may be quickly and readily assembled or disassembled without the use of any tools.

Yet another object of this invention is to provide a portable patch of ersatz turf in conjunction with the present invention that is so footed that it will retain any position in which it is placed even though a golf ball is driven from it.

A still further object of this invention is to provide a portable golf driving set that is reasonable to manufacture.

These and other objects are accomplished according to the present invention which comprises a quick assembly, rigid, vertical, rectangular net frame with net mounted on bilaterally attached unidirectional rockers, and a weighted and footed tee patch of artificial turf.

Other objects and many of the attendant advantages of this invention will be readily appreciated as the same becomes better understood by reference to the following detailed description which considered in connection with the accompanying drawings wherein.

Figure 1:
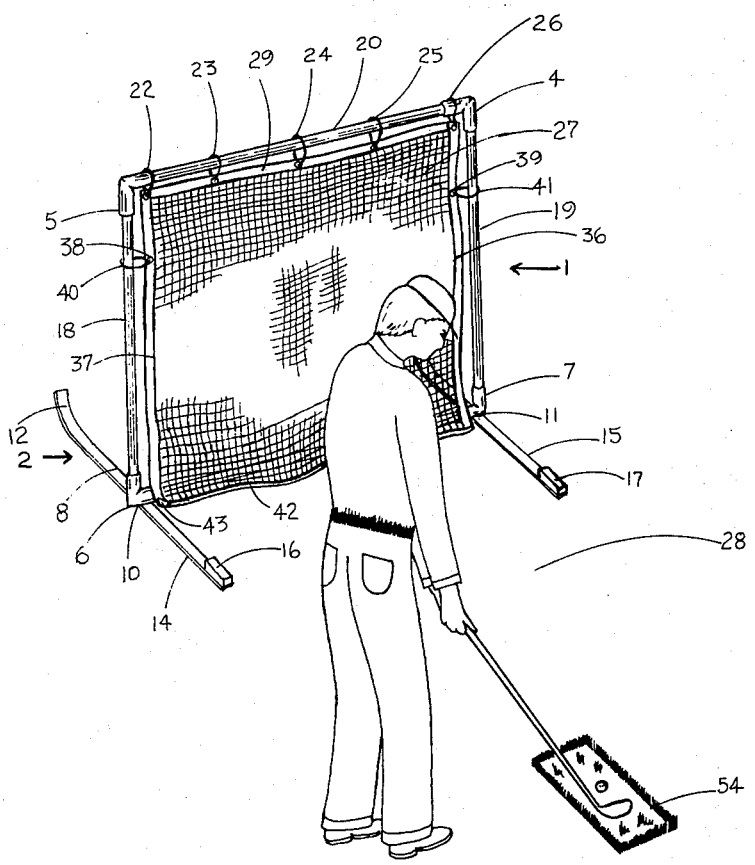
FIG. 1 is a perspective view showing a preferred embodiment of the current invention as it would appear set up ready for use.

In the drawings wherein for the purpose of illustration is shown a preferred embodiment of the invention and wherein similar reference characters designate corresponding parts throughout the several views, the net frame is designated 1.

Figure 2:
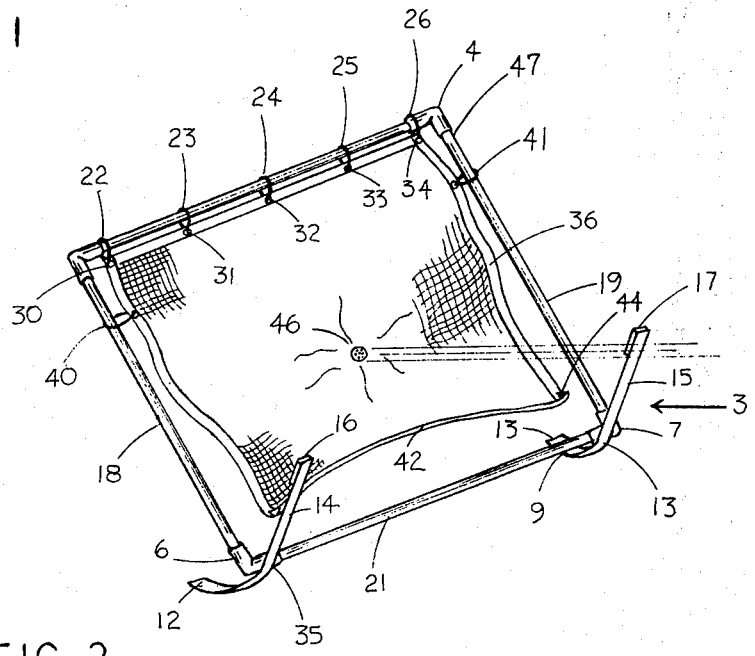
FIG. 2 is a perspective view showing the action of the catching net a few fractions of a second after a driven golf ball has impacted upon its surface.
Figure 3:
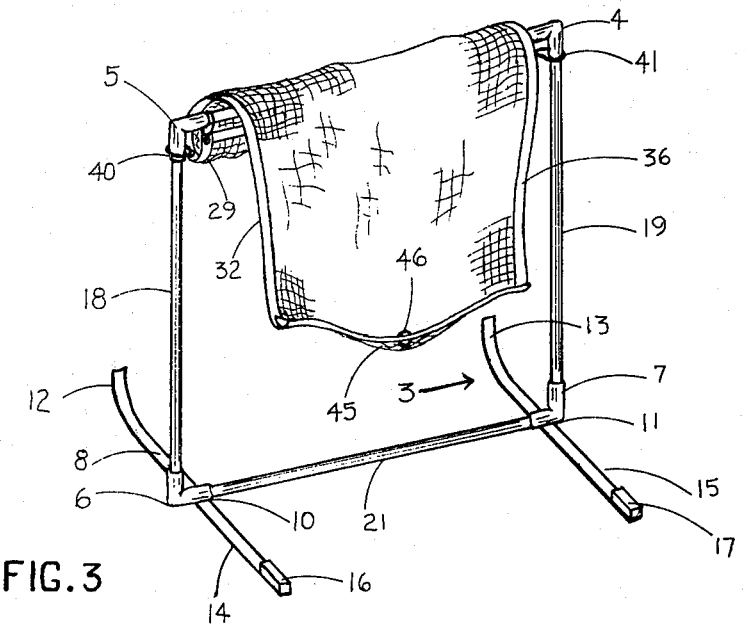
FIG. 3 is a perspective view showing the position of the catching net after the catch has been effected.

Referring to FIGS. 1–3, there is shown a preferred embodiment of the present invention which, in essence, comprises a vertical rectangular frame 1 fitted bilaterally at its lowermost extremity with a left 2 and right 3 unidirectional rocker which are perpendicular to the plane of the frame. Said frame 1 being fabricated in quick assembly/disassembly methology by the employment of two right angular female slip connectors, at its upper terminus a right slip connector 4 and a left slip connector 5 and two right angular female slip connectors 6 and 7 at its lower terminus which are integral components of unidirectional rockers 2 and 3 respectively. Said slip connectors 6 and 7 having been permanently affixed to unidirectional rockers 2 and 3 by welding or by other suitable means in such a manner that the vertical axis of slip connectors 6 and 7 are perpendicular to the horizontal axes of unidirectional rockers 2 and 3 respectively and the horizontal axes of the slip connectors 6 and 7 are parallel with the horizontal axes of unidirectional rockers 2 and 3 respectively, said slip connectors 6 and 7 being mounted on the upper surfaces 8 and 9 of unidirectional rockers 2 and 3 respectively with their vertical axes being centered widthwise and lengthwise on said unidirectional rockers 2 and 3 at the points 10 and 11 where said unidirectional rockers 2 and 3 evolve on the one hand into rocker arms 12 and 13 respectively and on the other hand into stabilizing feet 14 and 15. The horizontal lengths of slip connectors 6 and 7 protrude inboard of their respective mounting rocker in such a manner that the left unidirectional rocker 2 and right unidirectional rocker 3 are in essence mirror images one of the other. It is further noted that the stabilizing feet 14 and 15 of unidirectional rockers 2 and 3 have weights 16 and 17 installed at their outer terminus to provide greater vertical stability and residual vertical positioning of vertical frame 1.

Said slip connectors 4, 5, 6 and 7 respectively receive the terminal ends of four dowels 18, 19, 20 and 21 or other suitable framing material and thus through end to end series connection in cooperation with the slip connectors 4, 5 6 and 7 form the vertical frame 1. From the standing vertical frame there is suspended by means of a plurality of free riding retention clips 22, 23, 24, 25 and 26 a frame wide rectangular mesh net 27 which extends from a point near the top of frame 1 throughout its height toward the frame's base 35 and thence beyond until it contacts and rests upon the surface 28 upon which the frame 1 stands.

The rectangular mesh net 27 is firmly bound around its perimeter with a broad band reinforcement border of heavy flexible cloth or other suitable reinforcing type material. The upper border 29 is fitted with a plurality of permanently inserted grommets 30, 31, 32, 33 and 34 which serve to receive the free riding net retention clips 22, 23, 24, 25 and 26 by which said mesh net 27 is suspended. Additionally, the upper extremities of the right 36 and left 37 boarders have each been fitted with permanently inserted grommets 38 and 39 respectively for the purpose of receiving net lateral tensioning clips 40 and 41 respectively. Further, the lower border 42 of the rectangular mesh net 27 has been fitted at each corner with stiff semi-circular inserts, a left insert 43 and a right insert 44 which due to their right angular attachment cause the lower border 42 to curl throughout its length to assist in the formation of a net fold or pocket 45. The net 27 will operate satisfactorily without said inserts 43 and 44 being installed; however, their installation improves the net's ball retention capabilities; therefore they have been included within the presented preferred embodiment. The inventor of the present invention does in fact visualize two operative and satisfactory configurations of the subject invention, i.e., one that employs inserts such as inserts 43 and 44 and one the does not utilize inserts such as inserts 43 and 44.

Figure 4:
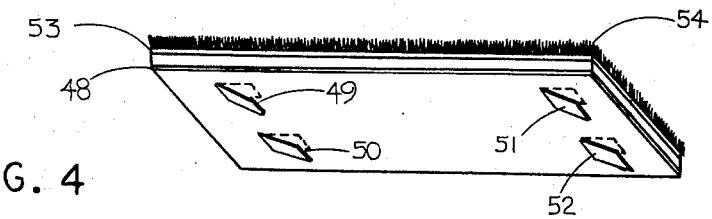
FIG. 4 is a perspective view of the teeing mat.
Figure 5:
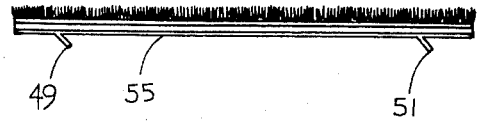
FIG. 5 is a side plan view of the teeing mat.
Figure 6:
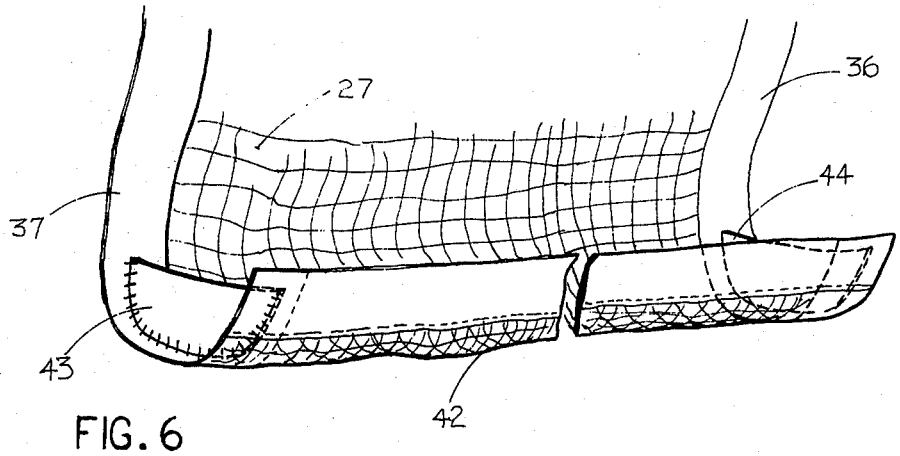
FIG. 6 is an isometric view of the net insert device.

The aforementioned mesh net 27 design is critical to the operation of the present invention for it is the cooperative effect of the vertical and lateral net suspension and its free flowing pocketed lower extremity which cooperate in unison with the unidirectional rockers 2 and 3 to effect a catch of a driven golf ball, whereupon the driven ball is retained in the mesh net until retrieved by the user. When a driven golf ball first impacts upon the mesh net 27 the lateral net tensioning clips 40 and 41 provide net tensioning and transmit the force vectors of the impacting ball 46 to the rocker mounted right and left frame uprights 18 and 19 which attempt to parallel the resultant vector of the impacting ball. In their efforts to parallel the impacting ball's resultant vector, the frame's 1 vertical uprights 18 and 19 rock backward on their unidirectional rockers 2 and 3, thus allowing the lateral net tensioning clips 40 and 41 to slip toward the upper terminus 47 of frame 1 whereupon they cooperate with vertical suspension clips 22, 23, 24, 25, and 26 to reverse the direction of the impacting ball 46 and cause it to loop back forward over the top of the upper frame member 20 where the mesh of the net in cooperation with its curled lower border 42 restricts further flight and the arrested ball is restrained until removed by the user. It is specifically noted that the stiffness of the lower border 42 determines whether or not an impacting ball will be caught and retained by the net or whether the impacting ball will be dropped from the net in such a manner that the ball will roll back to the golfer that initially drove it. A stiff lower border will cause the ball to be retained, a flexible lower border will allow the ball to be dropped from the net. Referring to FIGS. 4–5, the teeing mat from which the ball is driven in essence comprises three separate and distinct layers, each of which is bonded to the other by a suitable means. The platform layer 48, a rectangular flat plate device, has been fitted with a plurality of four feet 49, 50, 51, and 52 which serve in the main in such a manner that they prevent the teeing mat from slipping forward once it has been placed in position on a golf practice surface. To further assure that the teeing mat will remain in the position in which it was placed, a weighted layer 53 of a suitable high density material has been bonded to the upper rear surface of the platform layer 48. The weighted layer by increasing the loading on the four feet 49, 50, 51, 52 of the platform layer further causes the angularly mounted feet to dig into the surface on which they stand, thus materially adding to the stay power of the teeing mat. To add playing realism and to simulate natural conditions as nearly as possible, a third layer 54 fabricated from an ersatz turf such as Astro-Turf or similar material has been bonded to the upper surface of weighted layer 53.

The bonding of the ersatz turf 54 to the upper surface of the weighted layer 53 has been restricted to edge bonding only along those outer edges that comprise the rear half 55 of the upper surface of the teeing mat. Bonding in this manner assures the easy removal of damaged ersatz turf layers and their rapid replacement. In use, the entire device is placed on the surface a few feet (normally one club and arm length) in front of the framed mesh net 27 during practice and is used to provide a suitable support for the golf ball 55 prior to its being driven into the net 27. A variation to the teeing mat has been visualized by the inventor whereby the platform layer 48 is footless, being fabricated from non-slip material comprising a series of projections that serve to create friction with surfaces on which it is placed and thereby prevent movement of the teeing mat when balls are driven from its surface. Various changes may be made to the form of the invention herein shown and described without departing from the spirit of the invention or scope of the claims.

Having described this invention, what I assert as new and pray issuance of letters of patent for, is:

1. A device for arresting and retaining a ball in flight which comprises a rectangular vertically hanging net member suspended along its upper edge and upper vertical sides from an upright rectangular frame by means which permit said net to recoil away from the force of a ball in flight impacting said net from the front of said net and frame; said frame being mounted at its lower extremity on base means for permitting said frame also to rock in a backward direction from the impact of said ball and comprising two parallel elongated members disposed at right angles to the plane of said frame, the ends of said elongated members being weighted on the front side of the frame and being upturned on the other side of the frame; the lower edge of said net extending only as far as said base means and being upturned to retain said ball.

2. The device of claim 1 which is particularly adapted to arrest a given golf ball.

3. The device of claim 1 wherein said net is suspended from and attached to said frame by means of rings.

4. The device of claim 1 wherein said elongated members are slats.

* * * * *